US005839735A

United States Patent [19]

Benoit

[11] Patent Number: 5,839,735

[45] **Date of Patent: *Nov. 24, 1998**

[54] SKATE PROVIDING VENTILATION

[75] Inventor: Louis Benoit, La Balme De Sillingy, France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 735,391

[22] Filed: Oct. 21, 1996

[30] Foreign Application Priority Data

Oct. 27, 1995 [FR] France ..... 95 12908

[51] Int. Cl.[6] ..... A63C 17/04; A43B 5/04

[52] U.S. Cl. ..... 280/11.22; 36/115; 36/50.5

[58] Field of Search ..... 36/115, 50.5, 51; 280/11.22, 11.23

[56] References Cited

U.S. PATENT DOCUMENTS

| | | | |
|---|---|---|---|
| 3,939,583 | 2/1976 | Daumann | 36/115 |
| 4,050,108 | 9/1977 | Londner | 36/4 X |
| 4,282,659 | 8/1981 | Bourque et al. | 36/50.5 X |
| 4,351,537 | 9/1982 | Seidel | 280/11.12 |
| 4,509,276 | 4/1985 | Bourque | 36/115 |
| 5,171,033 | 12/1992 | Olson et al. | 280/11.22 |
| 5,189,815 | 3/1993 | Pozzobon et al. | 36/50.5 X |
| 5,357,695 | 10/1994 | Lu | 36/115 |
| 5,491,911 | 2/1996 | Chen | 36/115 X |

FOREIGN PATENT DOCUMENTS

| | | | |
|---|---|---|---|
| 0117372 | 9/1984 | European Pat. Off. . | |
| 0465223 | 1/1992 | European Pat. Off. . | |
| 572862 | 11/1993 | European Pat. Off. | 36/50.5 |
| 2331297 | 6/1977 | France . | |
| 3001380 | 9/1980 | Germany . | |

*Primary Examiner*—Ted Kavanaugh
*Attorney, Agent, or Firm*—Greenblum & Bernstein, P.L.C.

[57] ABSTRACT

An in-line roller skate boot obtained from an external sole and adapted to be affixed to the upper plate of a frame on which the wheels are arranged, and from which sole an upper covering the foot extends in the direction the skater's ankle, wherein the upper is composed of a first portion made of a relatively rigid material coming from the sole to form a shell base provided at its upper portion with a longitudinal opening extending from a raised zone that forms a rear stiffener up to the vicinity of an opposing end tip, and of a second portion constituting a vamp made of a relatively flexible attached material fixed on the circumference of the longitudinal opening of the shell base to cover a forefoot and contribute to obtain, together with the shell, the boot upper.

24 Claims, 3 Drawing Sheets

SKATE PROVIDING VENTILATION

BACKGROUND OF THE INVENTION

1. Field of the Invention

The present invention relates to a skate, such as for in-line roller skates, obtained from an external sole and adapted to be affixed, removably or not, to the upper plate of a frame on which the wheels constituting the gliding member are arranged, and from which sole an upper covering the foot extends in the direction of the skater's ankle.

2. Background and Material Information

This type of skate is adapted to the training of skaters on ice outside of a skating rink, but also for any athletes eager to maintain or perfect, on tarred hard ground, cement floor, etc., the techniques used in gliding sports such as trail skiing, cross country skiing, ice skating, etc.

Thus, the practice of this sport includes a driving or propelling phase that occurs by causing the skate to diverge outwardly and by taking a lateral support on the wheels that are thus inclined, in a manner similar to edge setting, then a gliding phase that occurs by repositioning the wheels perpendicularly with respect to the ground.

A boot of this type is known from the U.S. Pat. No. 5,171,033. This patent describes a boot which has the particularity of being made from a rigid shell of which one zone adjacent to the sole includes a plurality of ventilation openings leading into the internal volume of the shell. A liner or slipper is arranged freely in this shell such that the movements of the foot cause an internal ventilation through a cooperation between a pumping action provided by the movement of the slipper and the openings of the shell.

If such a concept is adapted to promote ventilation for the foot, it maintains however all of the boot's rigidity, because the shell, even if it receives a flexible slipper, constitutes a firm and uncomfortable foot enveloping structure. Furthermore, foot movement within the shell during practice of the sport is not desired for reasons related to the control of the skate, but also to comfort, any movement between the foot and the shell being capable of generating friction, and therefore the formation of blisters.

The various movements of the skater's foot to accomplish the aforementioned various skating phases, with effectiveness but also with comfort, have led to the search for a flexible and lightweight boot structure which further provides a good foot retention and usage comfort.

SUMMARY OF THE INVENTION

This objective has been achieved by the present invention which, to this end, relates to a skate such as an in-line roller skate, including an external sole and adapted to be affixed to the upper plate of a frame on which a grinding means, such as wheels, are arranged and from which sole an upper covering the foot extends in the direction the skater's ankle, wherein the upper is composed of a first portion made of a relatively rigid material extending from the sole to form a shell base provided at its upper portion with a longitudinal opening extending from a raised zone that forms a rear stiffener up to the vicinity of an opposing end tip, and of a second portion constituting a vamp made of a relatively flexible attached material and fixed on the circumference of the longitudinal opening of the shell base to cover a forefoot and contribute to obtain, together with the shell base, the boot upper. Indeed, such a construction of the upper achieves the objectives for both the foot retention by the shell base and the comfort and lightweight through the flexible portion of the upper.

The present invention also relates to the characteristics which will become apparent along the following description, and which are to be considered separately or according to all of their possible technical combinations.

BRIEF DESCRIPTION OF DRAWINGS

This description, provided by way of non-limiting examples, will help to better understand how the invention can be embodied, with reference to the annexed drawings, in which.

DETAILED DESCRIPTION OF THE PREFERRED EMBODIMENTS

Figure 1:
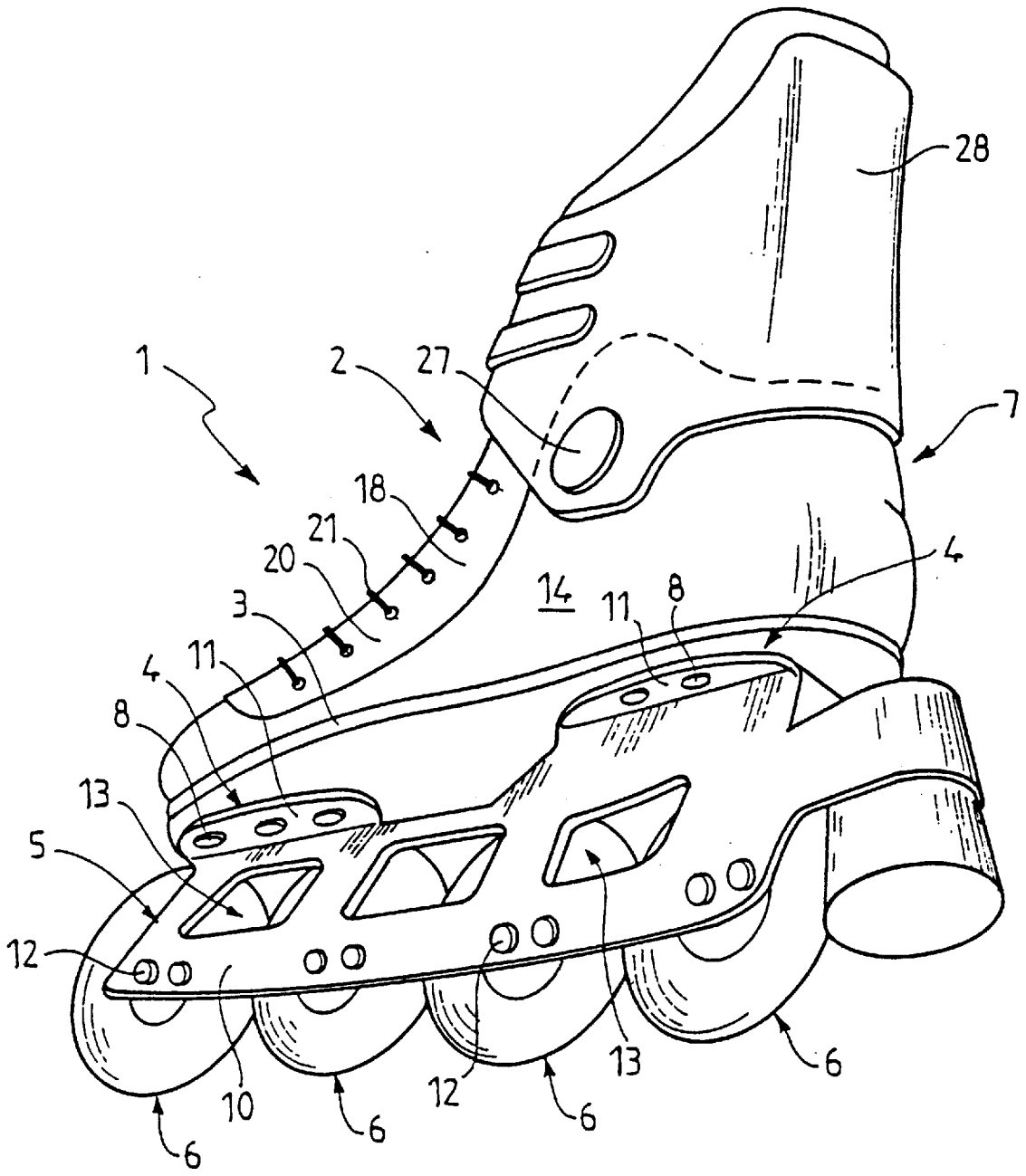
FIG. 1 is a perspective view of an in-line roller skate and of an associated shoe, according to the invention.

The in-line roller skate generally designated by the reference numeral 1 and shown in FIG. 1 includes a boot 2 constituted by an external sole 3 adapted to be affixed to the upper plate 4 of a frame 5 on which the wheels 6 are arranged. An upper 7 covering the entire foot extends from the sole 3 in the direction of the skater's ankle.

The sole 3 of the boot 2 is affixed to the frame 5 forming the horizontal upper plate 4 on which the sole 3 is attached by means of binding means which, in this case, are screws 8 that extends through the plate 4 so as to be tightened in the lateral edges of the sole 3. The sole can also be attached by means of rivets or other non-permanent binding means.

The frame 5 also includes a lower portion that is perpendicular to the plate 4 along its longitudinal axis and is, for example, constituted by two vertical lateral wings 10 parallel to one another and arranged on both sides of the longitudinal axis.

The lateral wings 10 are extended at their upper portion, respectively, by a perpendicular return 11, each of which is directed outwardly and constitutes a plane that defines the horizontal plate 4.

In this way, the vertical lateral wings 10 generally define, together with the sole 3 of the boot 2, an inverted U between the wings of which a plurality of wheels 6, as many as four, for example, are arranged by means of transverse journal axles 12 secured to the frame 4 to form a roller train.

Openings 13 have the essential role of lightening the frame 5 described hereinabove.

According to the invention, the upper 7 is generally composed of a first portion 14 made out of a relatively rigid material coming from the sole 3 to form a shell base provided at its upper portion with a longitudinal opening 15 which extends from a raised zone 16 forming a rear stiffener up to the vicinity of an opposing end tip 17, and of a second portion 18 which constitutes a vamp made out of a relatively flexible attached material fixed on the circumference of the longitudinal opening 15 of the shell base 14 to cover a forefoot and contribute to obtain, together with the shell base 14, the upper 7 of the boot 2.

In fact, the vamp 18 is obtained from a piece of a relatively flexible material constituted by a fabric so as to ensure both comfort and foot retention.

By way of example, the fabric constituting the flexible material from which the vamp 18 is obtained is a wide-mesh fabric forming a net.

On the other hand, the shell base 14 is made out of a rigid plastic material for an optimum foot retention.

Furthermore, the central zone of the flexible vamp 18 has a longitudinal slit 19 demarcating two transverse flaps 20, on respective opposite lateral sides of the upper, provided with tightening means 21 adapted to act after introduction of the skater's foot.

According to the present example, the tightening means 21 are constituted by laces arranged in a conventional manner, but they can also be constituted by any other means such as hooks, self-gripping systems, etc.

Figure 2:
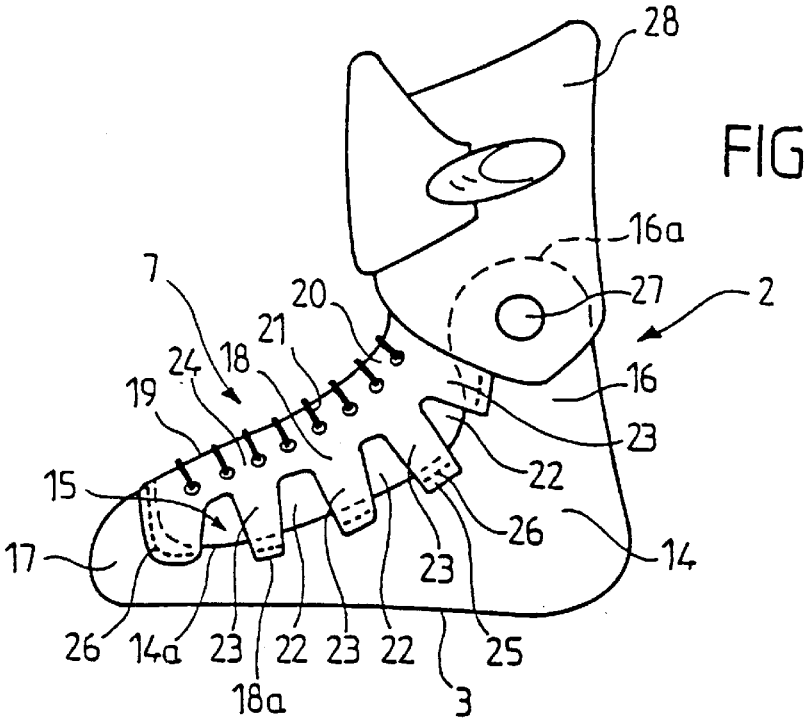
FIG. 2 a lateral view of a boot alone, according to a first embodiment of the invention.

According to the example of embodiment shown in FIG. 2, the vamp 18 is obtained from a piece of a relatively flexible material including two lateral notches 22 which extend from its lower peripheral edge 18*a* and are directed towards its longitudinal axis in a direction substantially perpendicular thereto, in order to obtain flexibility and lightening of the upper 7, while maintaining the necessary retention for the foot and also providing foot ventilation, in the manner of a light sandal, whose lateral strips 23 originating from a central zone 24 and demarcating the notches 22 cooperate fixedly through their free ends 25 with a peripheral edge 14*a* of the longitudinal opening 15 of the shell base 14.

Connection means 26 are arranged between the lower peripheral edge 18*a* of the vamp 18 and the upper peripheral edge 14*a* of the shell base 14.

These means 26 can be constituted by a peripheral seam joining the lower edge 18*a* of the vamp 18 with the upper edge 14*a* of the shell base 14, or by other binding means such as rivets, glue, etc.

According to another characteristic of the invention, the upper 7 is a low upper that does not extend upwardly beyond the rear stiffener 16, and has a journal 27 arranged in the vicinity of the upper ends 16*a* of the lateral walls of the rear stiffener 16 of the shell base 14 and adapted to receive a collar 28 for tightening a lower part of the leg, the collar 28 extending upwardly from its journal 27, beyond the upper end 16*a* of the upper 7.

This collar 28 is obtained from a semi-rigid plastic material and enables the upper to be retained laterally or maintained in a transverse direction while preserving the freedom of flexional movement of the foot/ankle journal.

According to another characteristic of the invention, the upper 7 constituted by the shell base 14, and the vamp 18 or the collar 28, includes at least one internal comfort element.

Figure 6:
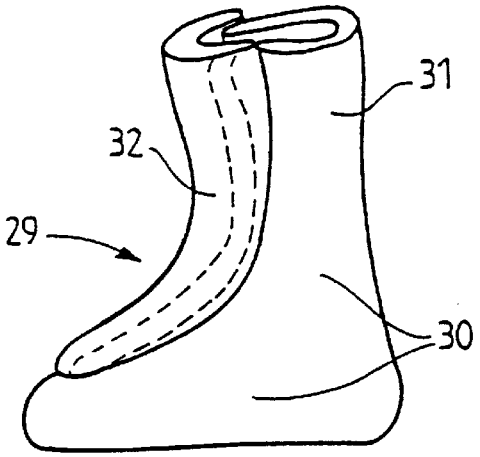
FIGS. 6 and 7 are perspective views of comfort elements according to variations which adapt indifferently to the boots according to FIGS. 2, 4 and 5.

According to the example of FIG. 6, the internal comfort element is constituted by a monoblock liner or slipper 29 that is removably slipped within the upper 7, the slipper 29 being constituted by a first lower rear portion 30 corresponding substantially to the shell base 14 and extending upwardly to constitute the rear zone 31 of the collar 28, and of a second front portion or tongue 32 affixed, in a flexible manner, to the first portion 30, 31 and corresponding substantially to the vamp 18.

This slipper thus constituted is, for example, made of a polyurethane foam, and the fact that it is removable will enable it, in a known manner, to be removed from the boot to be dried or washed.

Figure 7:
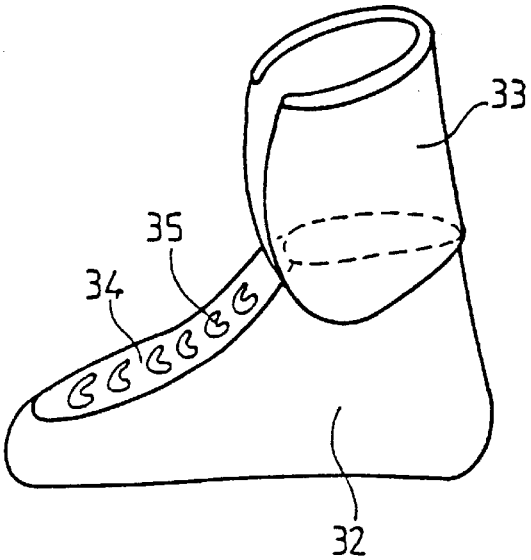

According to the embodiment shown in FIG. 7, the internal comfort element is made of two distinct parts 32 and 33, of which one part 32 is a slipper arranged fixedly within the low upper 7 constituted by the shell base 14 and the vamp 18, and whose other part 33 is a padding of the journalled collar 28 which constitutes the upper portion of the upper 7 and to which it is affixed.

In this case, and according to another characteristic, the slipper 32 includes, on its portion corresponding substantially to the vamp 18 of the upper 7, an elastic zone 34 adapted to promote the introduction of the foot and to enable the ventilation therefor by means of openings 35 provided therein.

Figure 3:
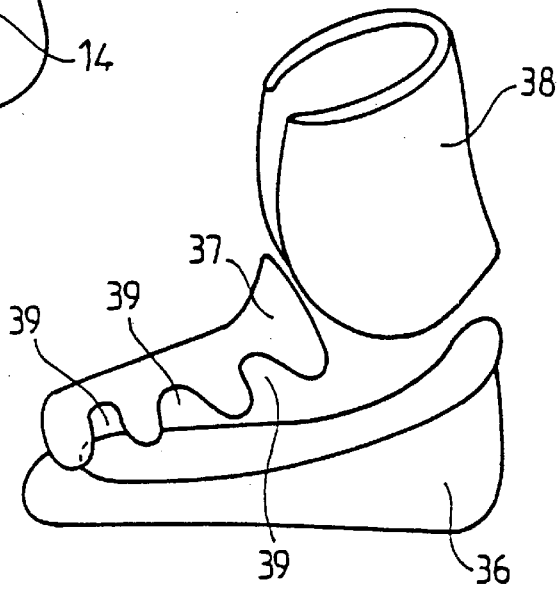
FIG. 3 is a perspective view of an internal comfort element more particularly adapted to the boot according to FIG. 2.

Finally, according to a design more particularly adapted to the boot according to FIG. 2, the comfort element shown in FIG. 3 is constituted by three parts 36, 37, and 38 the first 36 of which, corresponding to the internal volume of the shell base 14, is arranged freely therein and, in fact, constitutes an internal sole in the form of a shell; the second part 37, corresponding to the vamp 18 and assuming its contour, is a padding element which is affixed thereto; and the third part 38, corresponding to the journalled collar 28 forming the upper portion of the upper 7, is also a padding element affixed thereto.

One will note that in this specific case, the second part 37 of the comfort element forming the padding of the vamp 18 includes notches 39 corresponding to the notches 22 of the vamp 18.

Of course, the comfort elements shown in FIGS. 6 and 7 previously described can also be adapted in the boot shown in FIG. 2.

Whether or not a comfort element is present opposite the notches 22 of the vamp 18, one can also envision to arrange sealing elements, such as a water-repellent fabric, for example, behind the notches.

Figure 4:
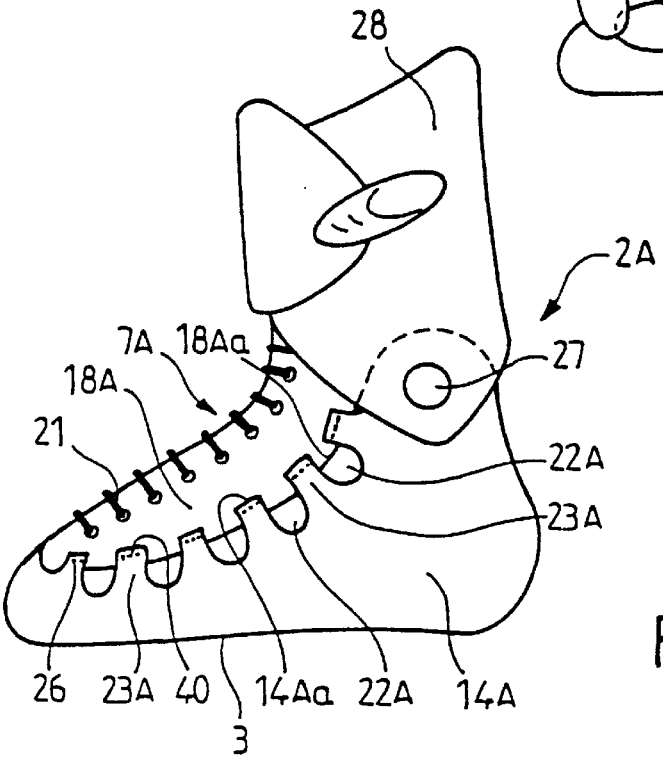
FIG. 4 is a lateral view of a boot alone according to a second embodiment of the invention.

The boot 2A as shown in FIG. 4 differs essentially from the previous one in that the shell base 14A is obtained by molding of a rigid plastic material, at the level of the peripheral upper edge 14Aa of which notches 22A have been provided, such notches extending from such edge and being directed substantially perpendicularly thereto towards the sole 3, in order to obtain flexibility and lightening of the upper 7A, lateral strips 23A demarcated by the notches 22A cooperating fixedly through their free ends 40 with a peripheral lower edge 18Aa of the vamp 18A.

Figure 5:
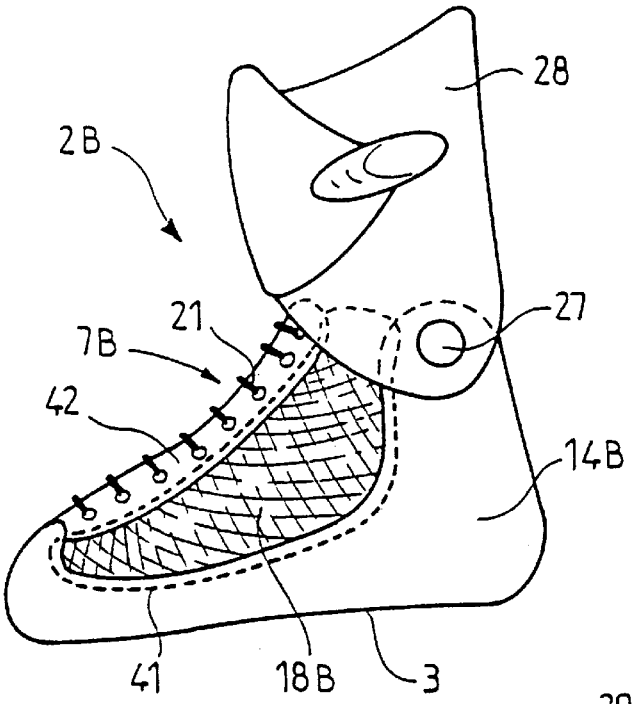
FIG. 5 is a lateral view of a boot alone according to a third embodiment of the invention.

The boot 2B shown in FIG. 5 differs essentially from the previous ones in that the vamp 18B is obtained from a wide-mesh fabric providing the upper 7B with the desired flexibility, without it being necessary to provide notches as in the preceding cases. In this case, the lower and upper peripheral edges of the vamp 18B and of the shell base 14B, respectively, are joined by a continuous peripheral seam 41.

According to this variation, the vamp 18B includes, in a longitudinal and central upper zone located on both sides of the transverse flaps, reinforcement elements 42 which are relatively flexible but are made of a different, more resistant material such as leather, and are adapted to receive the tightening means 21.

The instant application is based upon French Patent Application No. 95.12908 filed on Oct. 27, 1995, the disclosure of which is hereby expressly incorporated by reference thereto, and the priority of which is hereby claimed.

What is claimed is:

1. Skate comprising:

an external sole;

a frame with an upper plate, said external sole being affixed to said upper plate of said frame;

a gliding device arranged along said frame;

an upper having a shape to receive a foot, said upper extending from said sole upwardly toward an ankle of the foot, said upper comprising:

a first portion extending upwardly from said sole and extending from a toe area to a heel area to constitute a lower shell made of a generally rigid first material, said lower shell having a longitudinally extending peripheral edge defining a longitudinal opening;

a second portion comprising a vamp, said vamp being positioned above a forefoot and extending on opposite lateral sides of said upper and defining a longitudinally extending slit between said opposite lateral sides, said vamp having a peripheral edge, at least a portion of said peripheral edge of said vamp being affixed to said peripheral edge of said lower shell, said second portion being made of a second material having a greater flexibility than said first material, at least one of said first portion and said second portion having a ventilating portion positioned within a limit demarcating said longitudinal opening; and a tightening device attached to said vamp to tighten the foot in the upper of the skate, said tightening device being distinct from said ventilation portion.

2. Skate according to claim 1, wherein:

said ventilating portion comprises a piece of fabric.

3. Skate according to claim 2, wherein:

said ventilating portion comprises a wide-mesh fabric forming a net.

4. Skate according to claim 1, wherein:

said vamp includes a longitudinally extending slit demarcating two transverse flaps provided with said tightening device.

5. Skate according to claim 4, wherein said vamp comprises reinforcement elements located on both of said transverse flaps in a longitudinal and central area, said reinforcement elements being made of a material resistant to traction forces exerted on said tightening device.

6. Skate according to claim 1, wherein:

said first material comprises a rigid plastic material.

7. Skate according to claim 1, wherein:

said ventilating portion comprises notches formed by said peripheral edge of said lower shell.

8. Skate according to claim 7, wherein:

said notches define lateral strips of said lower shell extending substantially perpendicular to a longitudinal median plane of the skate, said lateral strips having free ends affixed to said peripheral edge of said vamp.

9. Skate according to claim 1, wherein:

said peripheral edge of said vamp is affixed to said peripheral edge of said lower shell by means of a peripheral seam.

10. Skate according to claim 1, wherein:

said upper further comprises a collar extending upwardly beyond an upper end of said lower shell for tightening the skate upon a lower leg, said collar comprising two lateral sides attached to said lower shell by means of a journal connection.

11. Skate according to claim 10, wherein:

said collar is made of a semi-rigid material.

12. Skate according to claim 1, wherein:

said vamp has a comfort element provided on an internal surface thereof.

13. Skate according to claim 12, wherein:

said upper further comprises a collar extending upwardly beyond an upper end of said lower shell for tightening the skate upon a lower leg, said collar comprising two lateral sides attached to said lower shell by means of a journal connection; and said collar has a comfort element provided on an internal surface thereof.

14. Skate according to claim 1, wherein:

said upper further comprises:

a collar extending upwardly beyond an upper end of said lower shell for tightening the skate upon a lower leg, said collar comprising a rear zone and two lateral sides attached to said lower shell by means of a journal connection; and an internal comfort element comprising a monoblock slipper removably fitted within the skate, said slipper including:

a lower rear portion corresponding substantially to a location of said lower shell, said slipper extending upwardly and covering said rear zone of said collar; and a front portion flexibly affixed to said lower rear portion and corresponding substantially to a location of said vamp.

15. Skate according to claim 1, wherein:

said upper further comprises:

a collar extending upwardly beyond an upper end of said lower shell for tightening the skate upon a lower leg, said collar comprising a rear zone and two lateral sides attached to said lower shell by means of a journal connection; and an internal comfort element comprising at least two distinct parts, said two parts comprising:

a slipper arranged fixedly within said lower shell and said vamp; and a padding affixed internally to said collar.

16. Skate according to claim 15, wherein:

said slipper comprises, on a portion corresponding to said vamp, an elastic zone that facilitates introduction of the foot within the skate.

17. Skate according to claim 1, wherein:

said upper further comprises:

a collar extending upwardly beyond an upper end of said lower shell for tightening the skate upon a lower leg, said collar comprising a rear zone and two lateral sides attached to said lower shell by means of a journal connection; and an internal comfort element comprising at least three distinct parts, said three parts comprising:

a first part arranged freely within said lower shell and corresponding to an internal volume of said lower shell;

a second part corresponding to said vamp and affixed internally to said vamp; and a third part corresponding to said collar and constituting a padding affixed internally to said collar.

18. Skate according to claim 1, wherein:

said ventilation portion is a portion of said vamp.

19. Skate according to claim 1, wherein:

said gliding device comprises an in-line series of rollers.

20. Skate comprising:

an external sole;

a frame with an upper plate, said external sole being affixed to said upper plate of said frame;

a gliding device arranged along said frame;

an upper having a shape to receive a foot, said upper extending from said sole upwardly toward an ankle of the foot, said upper comprising:

a first portion extending upwardly from said sole and extending from a toe area to a heel area to constitute a lower shell made of a generally rigid first material, said lower shell having a longitudinally extending peripheral edge defining a longitudinal opening;

a second portion comprising a vamp having a peripheral edge, at least a portion of said peripheral edge of said vamp being affixed to said peripheral edge of said lower shell, said second portion being made of a second material having a greater flexibility than said first material, at least one of said first portion and said second portion having a ventilating portion positioned within a limit demarcating said longitudinal opening, said ventilating portion comprising notches formed by said peripheral edge of said vamp; and a tightening device attached to said vamp to tighten the foot in the upper of the skate.

21. Skate according to claim 20, wherein:

said notches define lateral strips of said vamp extending substantially perpendicular to a longitudinal median plane of the skate, said lateral strips having free ends affixed to said peripheral edge of said lower shell.

22. Skate comprising:

an external sole;

a frame with an upper plate, said external sole being affixed to said upper plate of said frame;

a gliding means arranged along said frame;

an upper extending upwardly from said sole and having a shape to receive a foot, said upper comprising:

a first portion extending upwardly from said sole and extending from a toe area to a heel area to constitute a lower shell made of a generally rigid first material, said lower shell having a longitudinally extending peripheral edge defining a longitudinal opening;

a second portion comprising a vamp, said vamp being positioned above a forefoot and extending on opposite lateral sides of said upper and defining a longitudinally extending slit between said opposite lateral sides, said vamp having a peripheral edge, at least a portion of said peripheral edge of said vamp being affixed to said peripheral edge of said lower shell, said second portion being made of a second material having a greater flexibility than said first material;

means for providing ventilation for the skate, said means being at least in part within said longitudinal opening defined by said peripheral edge of said lower shell;

a tightening device attached to said vamp to tighten the foot in the upper skate, said tightening device being distinct from and spaced from said means for providing ventilation.

23. Skate according to claim 22, wherein:

said tightening device comprises a lace.

24. Skate according to claim 22, wherein:

said gliding means comprises an in-line series of rollers.

* * * * *